US007322668B2

(12) United States Patent
Kim

(10) Patent No.: US 7,322,668 B2
(45) Date of Patent: Jan. 29, 2008

(54) INKJET HEAD AND METHODS OF FABRICATING AND EXCHANGING THE SAME

(75) Inventor: Tae-kyun Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 230 days.

(21) Appl. No.: 11/004,801

(22) Filed: Dec. 7, 2004

(65) Prior Publication Data

US 2005/0280666 A1 Dec. 22, 2005

(30) Foreign Application Priority Data

Jun. 17, 2004 (KR) ..... 10-2004-0045156

(51) Int. Cl.
*B41J 2/015* (2006.01)
*B41J 2/165* (2006.01)

(52) U.S. Cl. ..... 347/21; 347/22

(58) Field of Classification Search ..... 347/20, 347/28, 43, 44, 48, 56, 60, 61, 66, 67, 21, 347/58.6

See application file for complete search history.

(56) References Cited

U.S. PATENT DOCUMENTS 4,148,041 A * 4/1979 Rosenstock ..... 347/28
5,493,319 A * 2/1996 Hirabayashi et al. ..... 347/29
5,840,883 A * 11/1998 Suzuki et al. ..... 563/103
6,074,037 A * 6/2000 Nakahara et al. ..... 347/29
6,637,855 B2 * 10/2003 Ide et al. ..... 347/23
6,783,205 B2 * 8/2004 Saijo et al. ..... 347/30

(Continued)

FOREIGN PATENT DOCUMENTS

CN 1408552 A 4/2003

(Continued)

OTHER PUBLICATIONS

Chinese Office Action dated Mar. 23, 2007 issued in CN 200510067443.3.

*Primary Examiner*—Shih-Wen Hsieh
(74) *Attorney, Agent, or Firm*—Stanzione & Kim, LLP

(57) ABSTRACT

Inkjet heads and methods of fabricating and exchanging the same. The inkjet head includes a substrate having a liquid supply hole; a nozzle plate disposed on an upper surface and provided with a nozzle hole to eject the liquid; a fluid channel forming layer disposed between the substrate and the nozzle plate and providing a chamber and a fluid channel to connect the chamber and the liquid supply hole; a heat-generating body disposed at the chamber to generate energy to eject the liquid; and a filler filled in the fluid channel to prevent air from being introduced into the fluid channel and allowed to cause phase transition into liquid. When the fluid channel forming layer and the nozzle plate are disposed on the substrate to constitute the head, the gel is injected into the fluid channel in the fluid channel forming layer to prevent air from being introduced into the fluid channel. When the head is newly mounted on the inkjet cartridge to be changed, the filled gel is ejected by an inherent operation of the head to eject ink droplets by expanding bubbles, and the ink stored in the ink cartridge is introduced into the fluid channel to be initially filled in the head while ejecting the gel.

29 Claims, 12 Drawing Sheets

U.S. PATENT DOCUMENTS

| | | | | |
|---|---|---|---|---|
| 6,811,243 | B2 * | 11/2004 | Pearlstine et al. | 347/28 |
| 6,871,934 | B2 * | 3/2005 | Masuyama et al. | 347/23 |
| 7,188,926 | B2 * | 3/2007 | Soga et al. | 347/28 |
| 7,198,351 | B2 * | 4/2007 | Wang et al. | 347/28 |

FOREIGN PATENT DOCUMENTS

| | | | |
|---|---|---|---|
| JP | 09-169111 | | 6/1997 |
| JP | 2000-037888 | | 2/2000 |
| JP | 2001-301119 | | 10/2001 |
| JP | 2002-096462 | | 4/2002 |
| JP | 2002-240308 | | 8/2002 |
| JP | 2002240308 | * | 8/2002 |

* cited by examiner

INKJET HEAD AND METHODS OF FABRICATING AND EXCHANGING THE SAME

CROSS-REFERENCE TO RELATED APPLICATIONS

This application claims the benefit of Korean Patent Application No. 2004-45156 filed on Jun. 17, 2004, the disclosure of which is hereby incorporated herein by reference in its entirety.

BACKGROUND OF THE INVENTION

1. Field of the Invention

The present general inventive concept relates to inkjet heads and methods of fabricating and replacing the same.

2. Description of the Related Art

Generally, an inkjet cartridge is a device for printing a predetermined image on a recording medium by ejecting ink droplets through an inkjet head.

FIG. 1 is a longitudinal cross-sectional view illustrating a configuration of a conventional inkjet cartridge 1.

Referring to FIG. 1, the inkjet cartridge 1 includes a cartridge body 11, a foam 13 inserted into the cartridge body 11 to retain ink, an ink supply unit 17 for supplying the ink from the foam 13 to a head 30, a filter 19 for filtering the ink when the ink is ejected from the ink supply unit 17, and a fluid-communicating hole 21 for facilitating the ink to come out of the foam 13 by providing communication between the cartridge body 11 and exterior air.

With this configuration, under the condition that the foam 13 having fine pores is pressurized and contained in the cartridge body 11, the cartridge body 11 is filled with a predetermined amount of ink. In this case, negative pressure is generated and maintained by a capillary phenomenon generated by the fine pores of the foam 13.

The head 30 may be classified into a thermal driving type and a piezo-electric driving type depending upon an ejection mechanism of an ink droplet. The thermal driving type generates bubbles in the ink by using a heat source and ejects the ink droplets by means of expansion of the bubbles, and the piezo-electric driving type ejects the ink droplets by means of pressure applied to the ink due to deformation of a piezoelectric material used therein.

FIG. 2 is a cross-sectional view illustrating a head structure of the prior art thermal driving type.

Referring to FIG. 2, a head 30 includes a substrate 31 having an ink supply hole 31*a*, a partition wall 37 installed on the substrate 31 to define an ink chamber 35 in which the ink is filled, a heat-generating body 39 installed in the ink chamber 35, and a nozzle plate 43 at which a nozzle hole 43*a*, through which the ink droplets are ejected, is formed. In this configuration, the ink supply hole 31*a* is in fluid communication with the ink supply unit 17 in FIG. 1.

In the head 30 configured above, first, when a pulse current is supplied into the heat-generating body 39 to generate heat therefrom, the ink 33 filled in the ink chamber 35 is heated to generate bubbles 45. As the generated bubbles are continuously expanded, the ink 33 filled in the ink chamber 35 is pressurized and ejected as ink droplets to an exterior through the nozzle hole 43*a*. Then, the ejection of the ink droplets is completed, and the bubbles are shrunk. When the bubbles are shrunk, the ink 33 is drawn back and refilled into the ink chamber. At this time, the shrinkage of the bubbles is caused by cooling of the heat-generating body 39 by switching off the pulse current.

Traditional inkjet printers, as shown in FIG. 1, have employed the inkjet cartridge traversing a width of a recording medium as a printing operation is performed.

However, recently, it becomes possible to manufacture a line type head, wherein the head extending throughout an entire width of the recording medium is fixedly maintained while the recording medium moves along the head.

FIG. 3 is a perspective view illustrating a configuration of an inkjet printer 100 to which a conventional line type head is adopted, disclosed in Japanese Patent Laid-open Publication No. 2001-301199, entitled "Inkjet Printer and Head Cartridge thereof."

Referring to FIG. 3, the inkjet printer 100 includes a line head 120 (hereinafter, referred to as "inkjet cartridge"), a paper conveying unit 130, a paper feeder 140, a paper tray 150, and an electric circuit unit 160, which are contained in a housing 110. The housing 110 has a shape of a rectangular parallelepiped, provided with a paper discharging port 111 for discharging paper P on one side and a tray insertion port 112 for accessing the paper tray 150 on the other side. The inkjet cartridge 120 is provided with ink reservoirs of four colors consisting of cyan, magenta, yellow and black.

FIG. 4 is a longitudinal cross-sectional view of the inkjet cartridge 120 in FIG. 3.

Referring to FIG. 4, a head frame 121 is installed at a lower portion of the inkjet cartridge 120, being integrally formed with an ink tank 122 (hereinafter, referred to as "cartridge body"). The head frame 121 is formed thereon with a slit-type ink supply hole 123 and has a head 124 attached to both sides of the each ink supply hole 123.

The inkjet cartridge 1 or 120 as described above, and as shown in FIGS. 1 and 4, may be generally classified into two types: a disposable type where the head 30 or 124 is integrally formed with the cartridge bodies 11 and 122, and a head replacable type, while not shown, where the head is configured to be separated from the cartridge body.

For the former, the head 30 or 124 is connected to an ink supply system to fill the ink into a fluid channel of an inner portion thereof by a manufacturer.

However, for the latter, when the ink exists in the fluid channel of the inner portion of the head, leakage of the ink may be generated, thus making distribution of the products difficult, and causing an electrical failure. Therefore, in this case, the head is provided into the market without the ink in the fluid channel being in the inner portion of the head.

However, since an inner portion of the cartridge body has a negative pressure lower than an atmospheric pressure by virtue of a negative pressure generating means such as the foam 13, it is impossible for the ink in the cartridge body to be naturally introduced into the fluid channel of the head. Therefore, in the prior art, when the head is exchanged with a new one in the cartridge body, an auxiliary device, such as a suction apparatus, has been adopted in order to initially fill the ink. The suction apparatus includes a suction cap in contact with an outer surface of the head, and a suction pump connected to the suction cap through a tube. When a pumping force of the suction pump is allowed to provide a suction force to the suction cap, a predetermined quantity of the ink is forcedly discharged through a nozzle hole of a nozzle plate by the suction force.

When the suction apparatus is mounted in the printer and a user mounts a newly replaced inkjet cartridge on the printer, the suction apparatus is automatically operated by a maintenance program to introduce the ink stored in the cartridge body into the fluid channel in the head.

As described above, the conventional head exchangeable inkjet cartridge has a problem in that the suction apparatus is additionally required in order to introduce the ink in the fluid channel into the replaced head.

In addition, the conventional cartridge has a disadvantage of increasing loss of the ink as the suction operation is performed. Furthermore, a wide area of the head, like the line head type shown in FIGS. 3 and 4, increases the loss among of the ink.

In addition, in case of the line head type, the increase of the head area enhances possibility of generating a sealing leakage from the suction cap. In this case, the suction operation cannot be smoothly performed, so that the air remaining in the fluid channel in the head deteriorates the printing quality.

SUMMARY OF THE INVENTION

It is an aspect of the present general inventive concept to provide an inkjet head capable of initially filling ink in a fluid channel in a newly replaced head by a driving device of the head itself without using an individual suction apparatus.

It is another aspect of the present general inventive concept to provide a method of fabricating the inkjet head described above.

It is another aspect of the present general inventive concept to provide a method of replacing an inkjet head using the described inkjet head.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an inkjet head including; a substrate having a liquid supply hole; a nozzle plate formed at an upper surface of the substrate and having a nozzle hole to eject liquid; a fluid channel forming layer disposed between the substrate and the nozzle plate and providing a chamber and a fluid channel to connect the liquid supply hole and the chamber; a heat-generating body disposed at a position of the chamber to generate energy for liquid ejection; and a filler filled in the fluid channel and allowed to cause a phase transition into liquid by a heating operation of the heat-generating body.

The filler can be made of gel, and the gel can be one selected from a group consisting of phthalic acid, glycerol, unsaturated polyester, collagen and agar. The gel can have a sol-gel transition temperature of about 0 to 100° C., and more preferably a sol-gel transition temperature of about 5 to 60° C. The gel can have a viscosity of sol of about 10 to 70 centipoises.

The substrate may further include an auxiliary heat-generating body to heat the substrate to a predetermined temperature.

The foregoing and/or other aspects and advantages of the present general inventive concept also may be achieved by providing a method of fabricating the inkjet head including: providing a substrate having a heat-generating body thereon to generate energy for liquid ejection, a fluid channel forming layer having a chamber to eject the liquid and a fluid channel for communicating fluid between the chamber and a liquid supply hole, and a nozzle plate provided with a nozzle hole to eject the liquid; and filling a filler to prevent air from being introduced into the fluid channel.

In filling the filler, the gel is introduced into the fluid channel in a liquid state at a high temperature, and then in a gelatinized state at a low temperature.

The gel may be made of one selected from a group consisting of phthalic acid, glycerol, unsaturated polyester, collagen and agar. The gel can have a sol-gel transition temperature of about 0 to 100° C., and more preferably a solgel transition temperature of about 5 to 60° C. The gel can have a viscosity of sol of about 10 to 70 centipoises.

The substrate may further include an auxiliary heat-generating body to heat the substrate to a predetermined temperature.

The foregoing and/or other aspects and advantages of the present general inventive concept also may be achieved by providing a method of replacing an inkjet head including: providing the inkjet head fabricated by a method including forming, on a substrate, a heat-generating body to generate energy for liquid ejection, a fluid channel forming layer to form a chamber to eject liquid and a fluid channel to provide a liquid supply path connected to the chamber, and a nozzle plate having a nozzle hole to eject the liquid; and injecting the filler into the fluid channel, the filler preventing air from being introduced into the fluid channel and allowed to cause a phase transition into a liquid state; disposing the inkjet head at the head frame; inserting the head frame to a head mounting groove of the inkjet cartridge to be replaced; and heating the filler to a predetermined temperature to eject the filler toward an exterior through the nozzle hole.

It is an aspect that before ejecting the filler, the operation of heating the filler to the predetermined temperature to change the filler into a liquid phase can be further included.

In the above configuration, preheating the filler may be performed by heating the auxiliary heat-generating body, which is additionally formed on the substrate, or by applying a pulse current, lower than that required to eject the liquid, to the heat-generating body.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
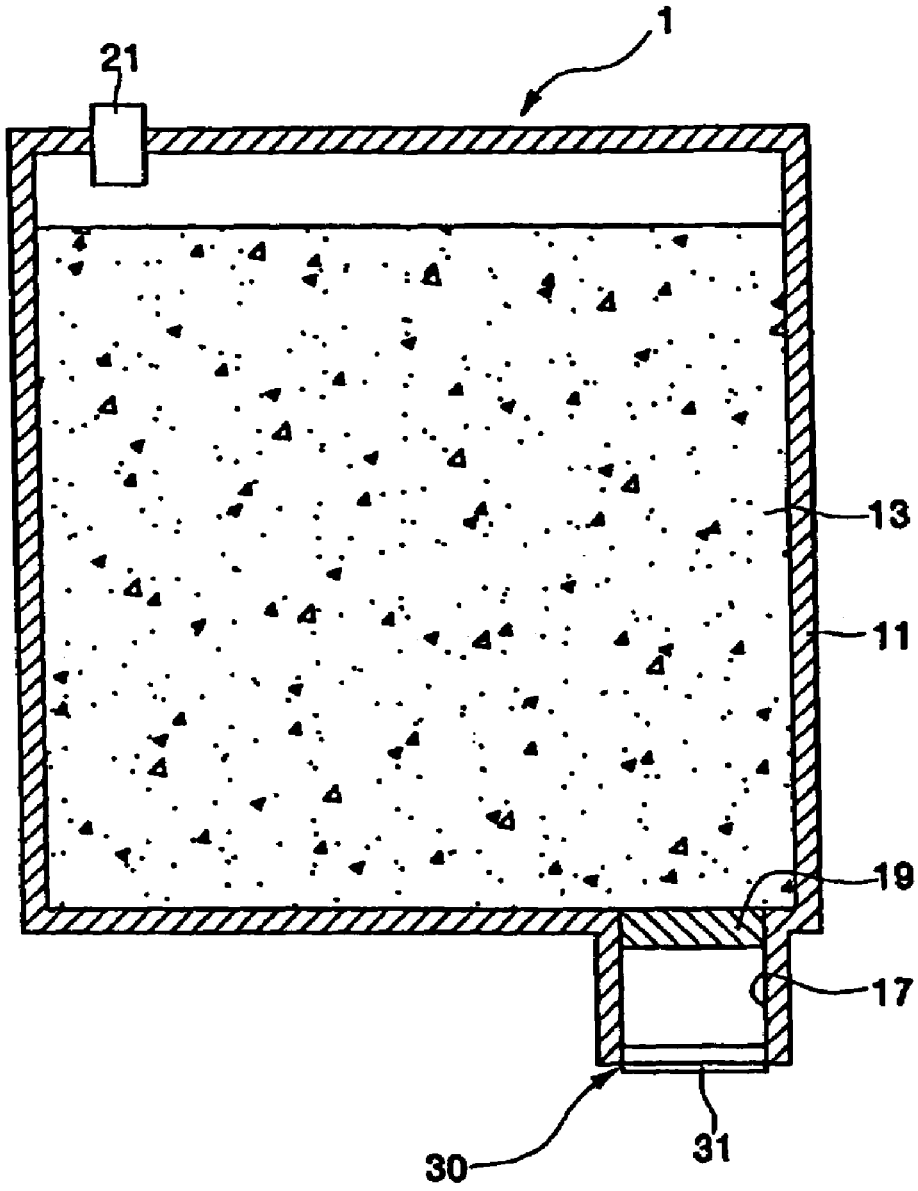
FIG. 1 PRIOR ART
FIG. 1 is a longitudinal cross-sectional view illustrating a configuration of a conventional inkjet cartridge.
Figure 2:
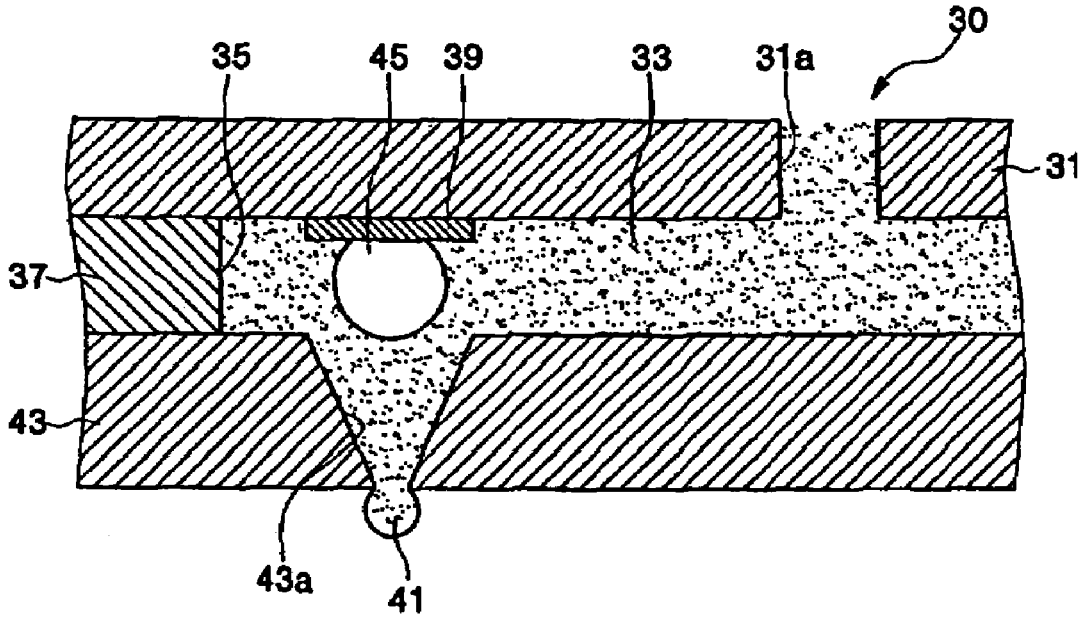
FIG. 2 PRIOR ART
FIG. 2 is a cross-sectional view illustrating a structure of a print head in a prior art thermal driving type head.
Figure 3:
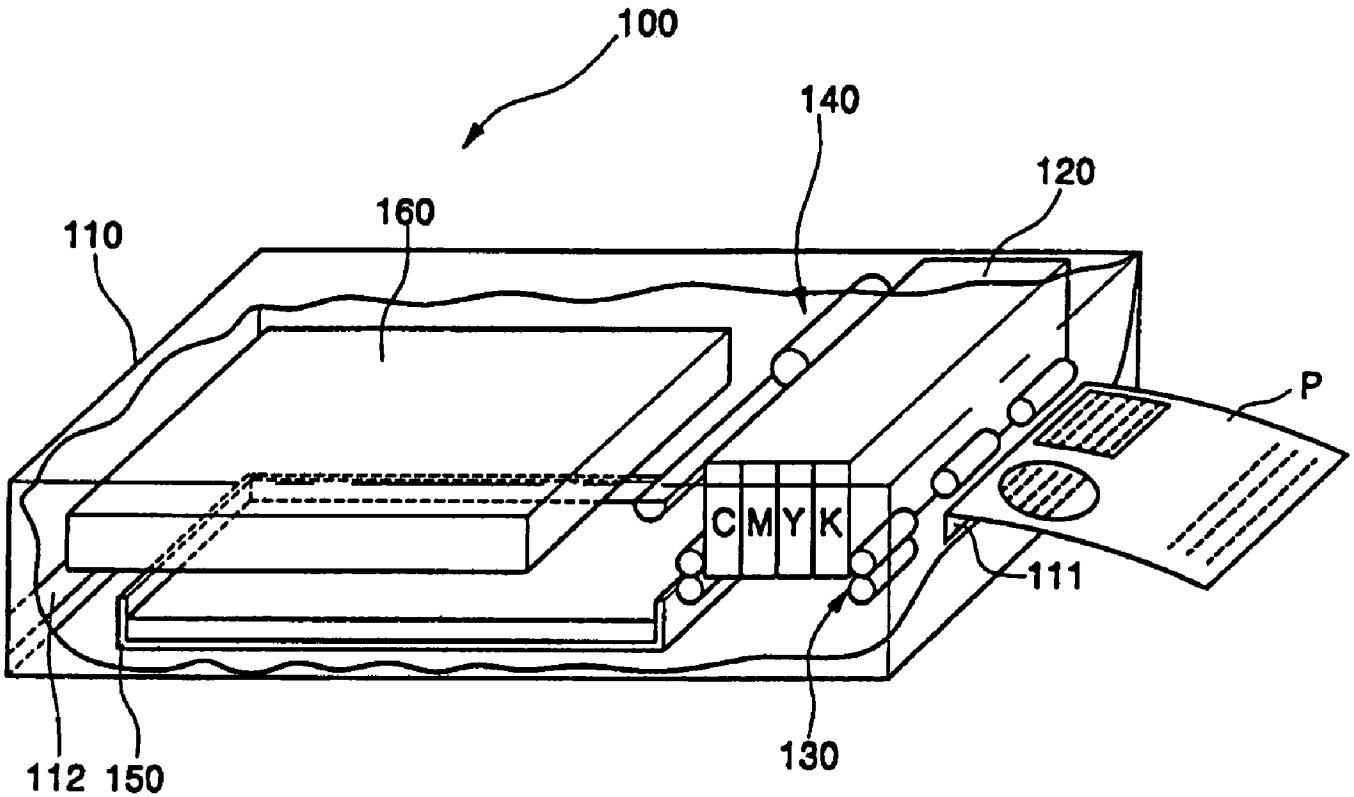
FIG. 3 PRIOR ART
FIG. 3 is a perspective view illustrating a configuration of an inkjet printer to which a prior art line type head is adopted, which is disclosed in Japanese Patent Laid-open Publication No. 2001-301199.
Figure 4:
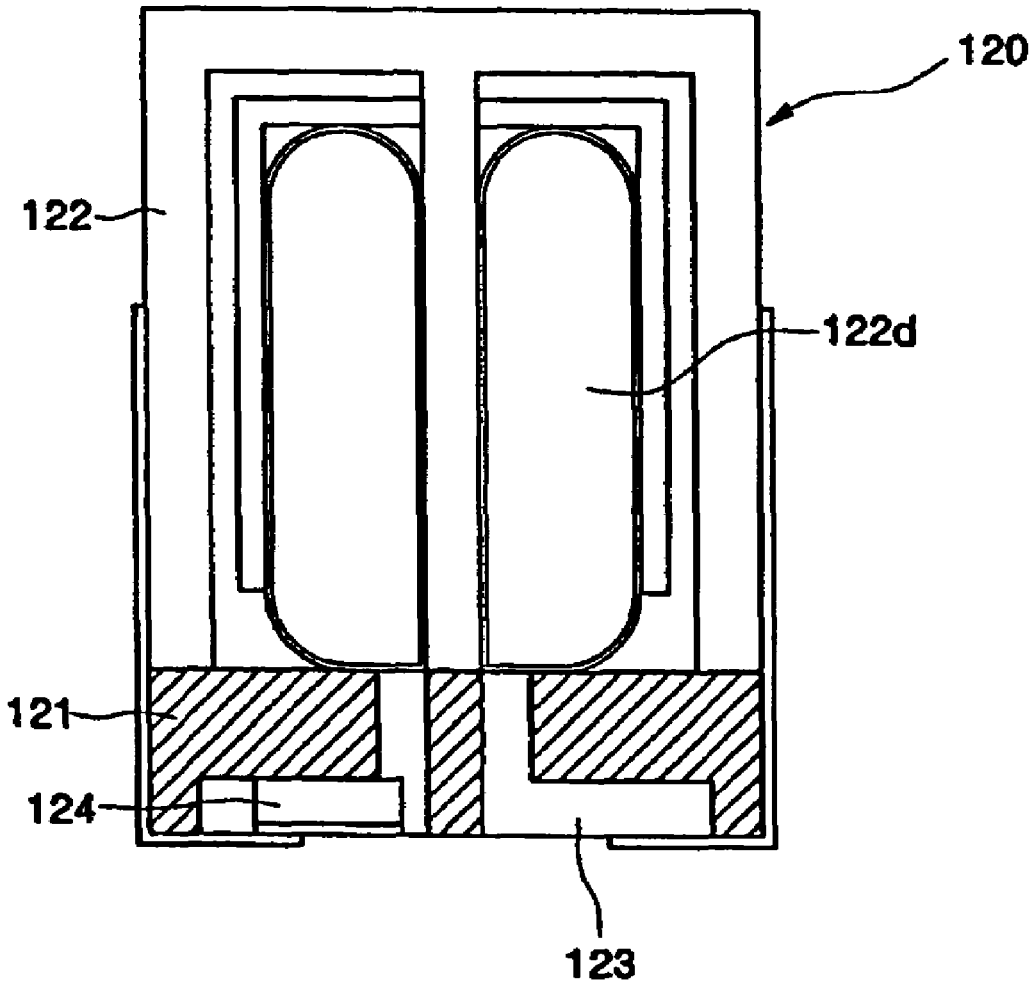
FIG. 4 PRIOR ART
FIG. 4 is a longitudinal cross-sectional view of the inkjet cartridge shown in FIG. 3.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 5:
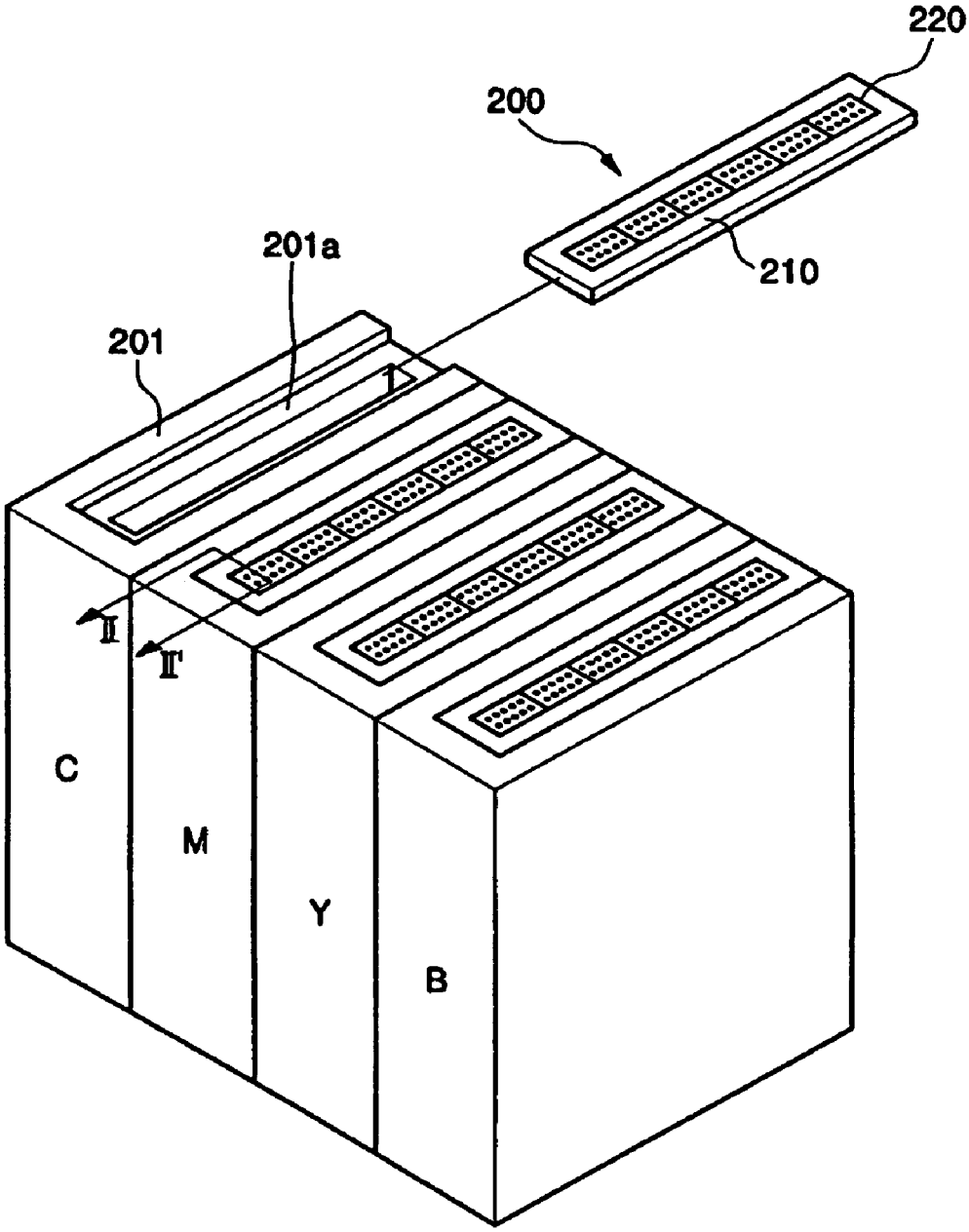
FIG. 5 is a view illustrating a configuration of an inkjet cartridge in accordance with an embodiment of the present general inventive concept.

FIG. 5 is a view illustrating a configuration of an inkjet cartridge in accordance with an embodiment of the present general inventive concept.

Referring to FIG. 5, a line head module 200, which is capable of printing almost simultaneously throughout an entire width of a recording medium, is detachably inserted into an inkjet cartridge 201.

The inkjet cartridge 201 is partitioned into spaces to receive the ink of four colors consisting of cyan, magenta, yellow and black, and is provided with a line head module mounting groove 201*a* on its bottom surface, to insert the line head module 200 and fix it.

The line head module 200 has a head frame 210 having a size to be inserted into the line head module mounting groove 201*a*, and a plurality of unit heads 220 arranged in the head frame 210.

Figure 6:
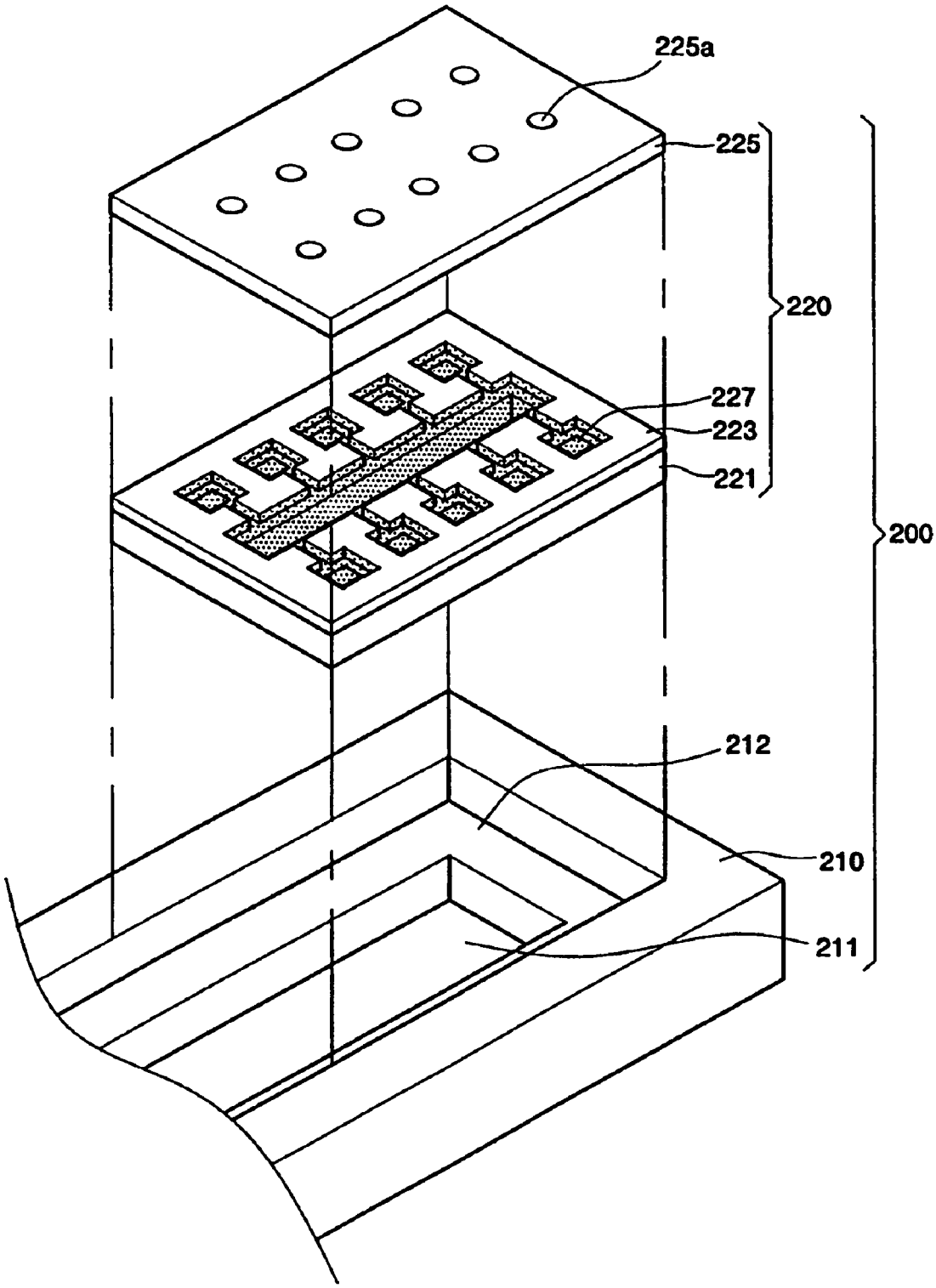
FIG. 6 is a partially enlarged view illustrating a disassembled line head module shown in FIG. 5.

FIG. 6 is a partially enlarged view illustrating the line head module 200 disassembled.

Referring to FIG. 6, the head frame 210 is provided with a liquid supply hole 211 (hereinafter, liquid is referred to as "ink"), and a step 212 to mount the head 220.

The head 220 includes a substrate 221, a fluid channel forming layer 223, a nozzle plate 225 and a heat-generating body 227.

Figure 7:
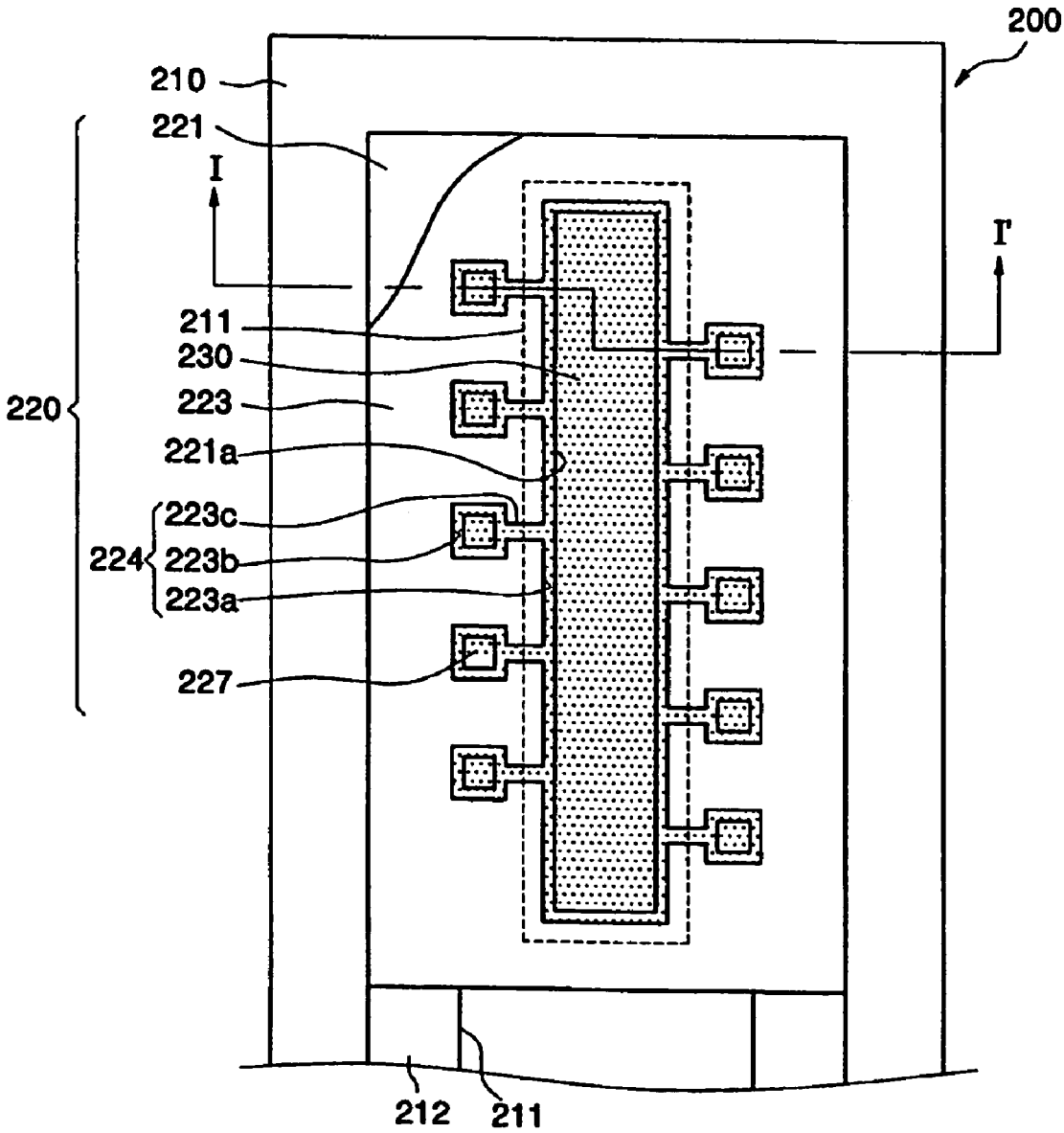
FIG. 7 is a plan view partially taken of a fluid channel-forming layer 223 with a nozzle plate removed from FIG. 6.
Figure 8:
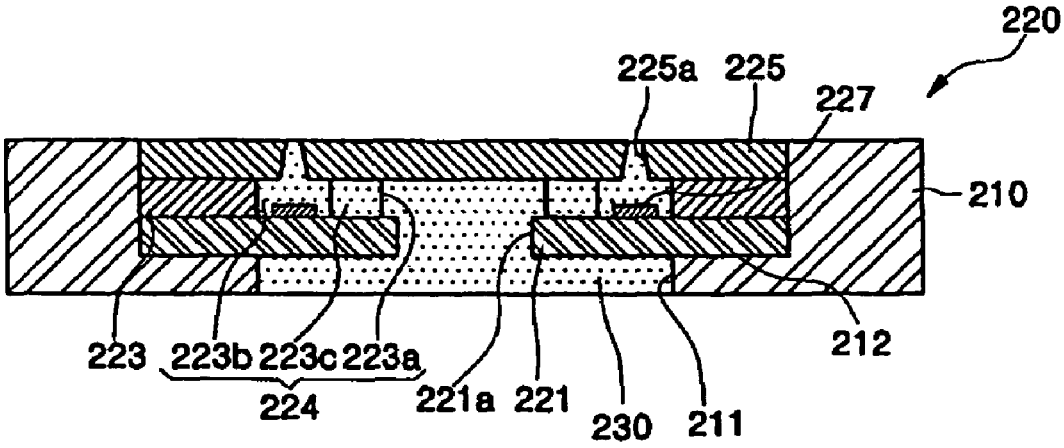
FIG. 8 is a cross-sectional view taken along the line I-I' shown in FIG. 7.

FIG. 7 is a plan view partially taken from the fluid channel-forming layer 223 with the nozzle plate removed from FIG. 6; FIG. 8 is a cross-sectional view taken along the line I-I' shown in FIG. 7; and FIG. 9 is an enlarged view partially taken of the head 200 in accordance with an embodiment of the present general inventive concept.

Figure 9:
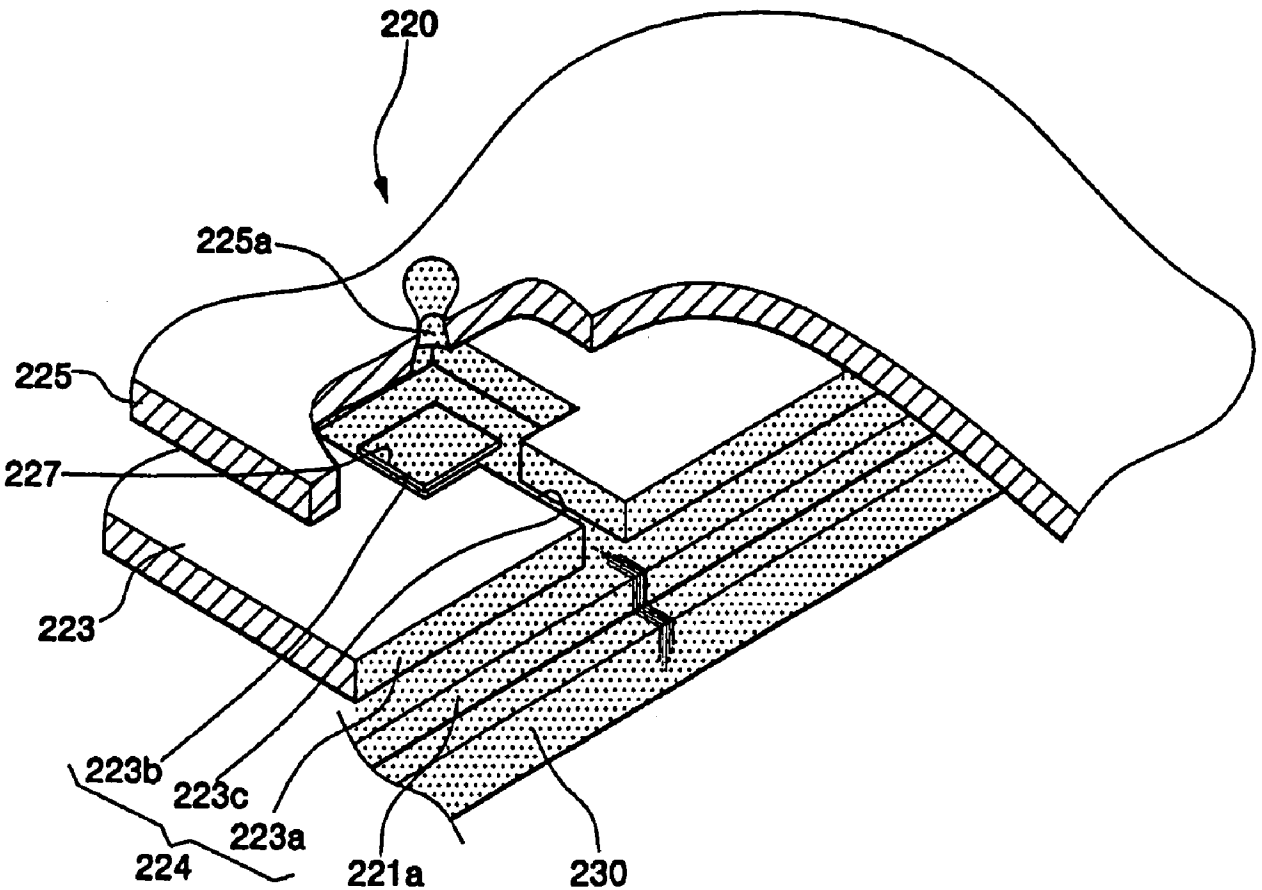
FIG. 9 is an enlarged view partially taken of a head 200 in accordance with the embodiment of FIG. 5.

The head 220 shown in FIGS. 7, 8 and 9 is an example of the line head module type, with a gel being filled in the head before the head 220 is mounted on the inkjet cartridge 201.

Referring to FIGS. 7, 8 and 9, the substrate 221 has an ink supply hole 221*a* corresponding to the ink supply hole 211 of the head frame 210 at its center portion.

The substrate 221 is provided with a fluid channel forming layer 223 to form a fluid channel 224 on its upper side.

The fluid channel 224 includes an ink via-hole 223*a* in fluid communication with the ink supply hole 221*a*, a plurality of chambers 223*b*, and a restrictor 223*c* to connect the ink via-hole 223*a* and the chambers 223*b*.

The chamber 223*b* is provided with a heat-generating body 227 to generate heat to provide an ink ejecting force. Though the heat-generating body 227 is illustrated to be formed on the substrate 221, the heat-generating body 227 can be formed on a nozzle plate 225 described hereinafter.

Referring to FIG. 8, the nozzle plate 225 is installed on an upper side of the fluid channel forming layer 223 and has a nozzle hole 225*a* to eject the liquid droplets, generated by the heating operation of the heat-generating body 227, at a position corresponding to the chamber 223*b*.

The filler 230 is filled into the ink supply hole 211 of the head frame 210, the ink supply hole 221*a* of the substrate 221, and the fluid channel 224 of the fluid channel forming layer 223, thereby preventing air from being introduced therein.

The filler 230 may be a gel, having a high viscosity at a low temperature and a low viscosity at a high temperature (hereinafter, the filler 230 is referred to as "gel"). The gel designates a phase in which several or tens of sub-units are aggregated, and the aggregation is accelerated to be changed into a network structure when predetermined conditions are satisfied in the state that the sub-units (particles, high molecular substances, and colloids) are being dispersed in a solvent (generally, such a state is referred to as "sol"). In this process, the aggregation of the sub-units is progressed in an unstable state to form a cluster, thereby resulting in gelatinization. At this time, a bonding force aggregated to each other may generate a chemical bond or a physical bond, or both bonds simultaneously. That is, the gel with a high viscosity in a low temperature is transitioned to sol with a low viscosity in a high temperature. Depending upon a type of gel, the sol-gel transition temperatures are different. In addition, the viscosity of the gel is rapidly varied around the transition temperature.

Figure 10:
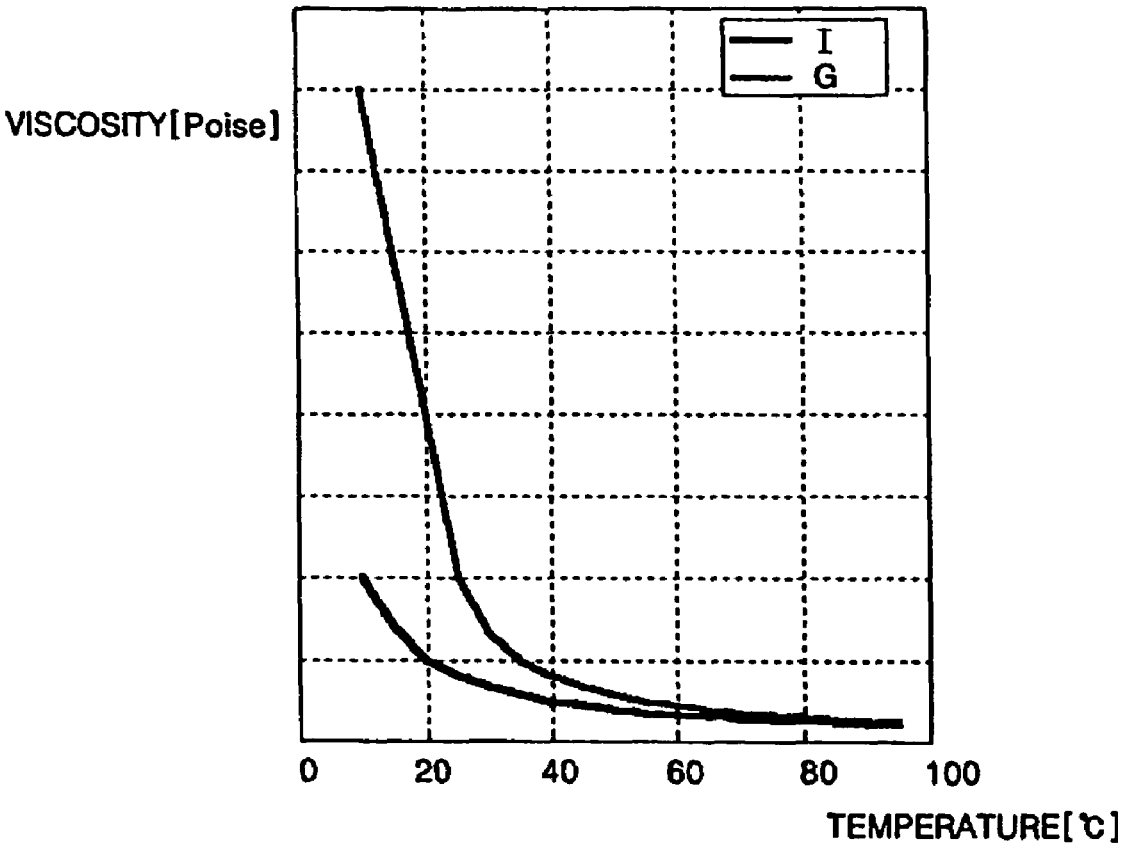
FIG. 10 is a graph representing viscosity properties depending upon temperature between a material G perform gelatinization as intended by the present general inventive concept and ink I that is generally used in an inkjet printer head.

FIG. 10 is a graph representing viscosity properties depending upon temperature between a material G that performs gelatinization as intended by the present general inventive concept and an ink I that is generally used in an inkjet printer head.

Referring to FIG. 10, the gelatinization of the gel 230 is generated at a specific temperature to rapidly raise the viscosity.

The gel 230 used in the present general inventive concept is one selected from a group consisting of phthalic acid, glycerol, unsaturated polyester, eatable collagen or agar. In this configuration, the agar is typically a hydrocolloid having a solgel transition property around a room temperature. The agar has a liquefaction temperature (that is, gel-sol transition) of about 50° C. in raising the temperature and a gelatinized temperature of about 35° C., and generates the phase transition reversibly by a factor of temperature only.

The gel 230 adopted in the present general inventive concept may use a gel with a sol-gel transition temperature of about 0 to 100° C., and preferably about 5 to 60° C.

The gel 230 preferably has a viscosity of sol of about 10 to 70 centipoises.

Figure 11:
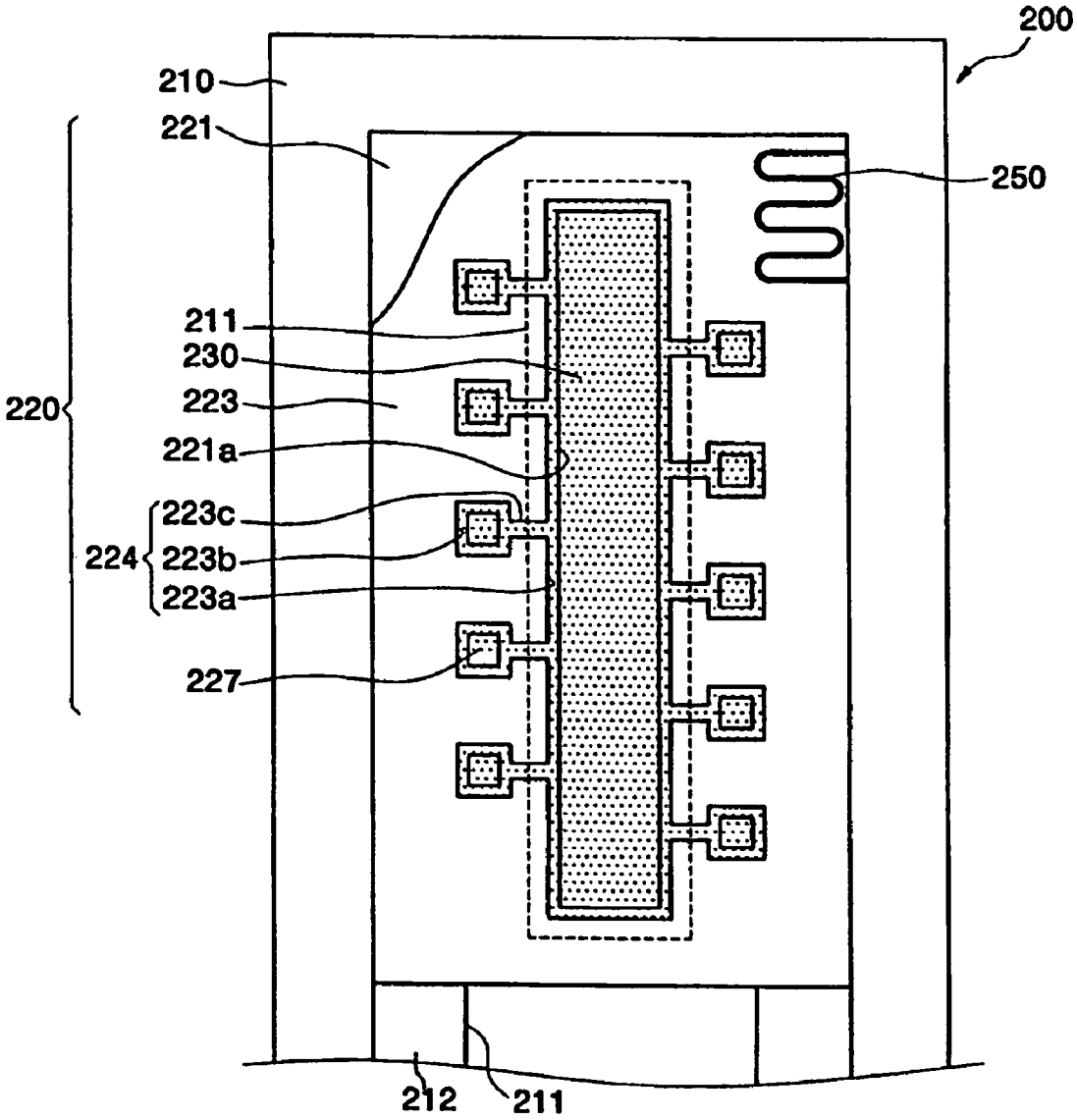
FIG. 11 is a view illustrating an inkjet head in accordance with another embodiment of the present general inventive concept.

FIG. 11 is a view illustrating an inkjet head in accordance with another embodiment of the present general inventive concept. Hereinafter, the same named components as described hereinabove will be represented by the same reference numbers, and so their descriptions will be omitted.

Referring to FIG. 11, an auxiliary heat-generating body 250 is additionally installed on the substrate 221. The auxiliary heat-generating body 250 functions to preheat the gel 230 to be transitioned into a liquid phase, thereby more rapidly ejecting the gel 230 through the nozzle hole 225*a*. In this configuration, the heat-generating body 227 may also preheat the gel 230 to be transitioned into the liquid phase. At this time, the current applied to the heat-generating body 227 should become lower than the pulse current to perform the actual ejection.

The head 220, as configured above, can be fabricated by the following method.

First, a basic structure of the head 220, such as the substrate 221, the fluid channel forming layer 223, the nozzle plate 225 and the heat-generating body 227, can be fabricated by various known methods, and their descriptions will therefore be omitted.

Next, the gel, an essential element of the present general inventive concept, is injected into the fluid channel 224 of the fluid channel forming layer 223.

The gel 230 is first heated to a predetermined temperature to be transitioned into the liquid phase, and then injected into the fluid channel.

Afterwords, when the gel is left in a state of room temperature, gelatinization is progressed to maintain a high viscosity, thereby preventing air from being introduced into the fluid channel 224 of the head 200.

Hereinafter, a method of replacing the head 220 (fabricated by the method described above) in the inkjet cartridge 201 will be described.

Referring to FIG. 5, the line head module 200, to be replaced, is inserted into the line head module mounting groove 201*a*.

Next, a series of processes of injecting the gel into the fluid channel of the head 200, transitioning the gel into the liquid phase, and ejecting the gel are carried out through a heat-generating operation of the heat-generating body 227, and then the ink stored in the inkjet cartridge 201 is introduced into the fluid channel 224. Hereinafter, their descriptions will be provided.

Figure 12:
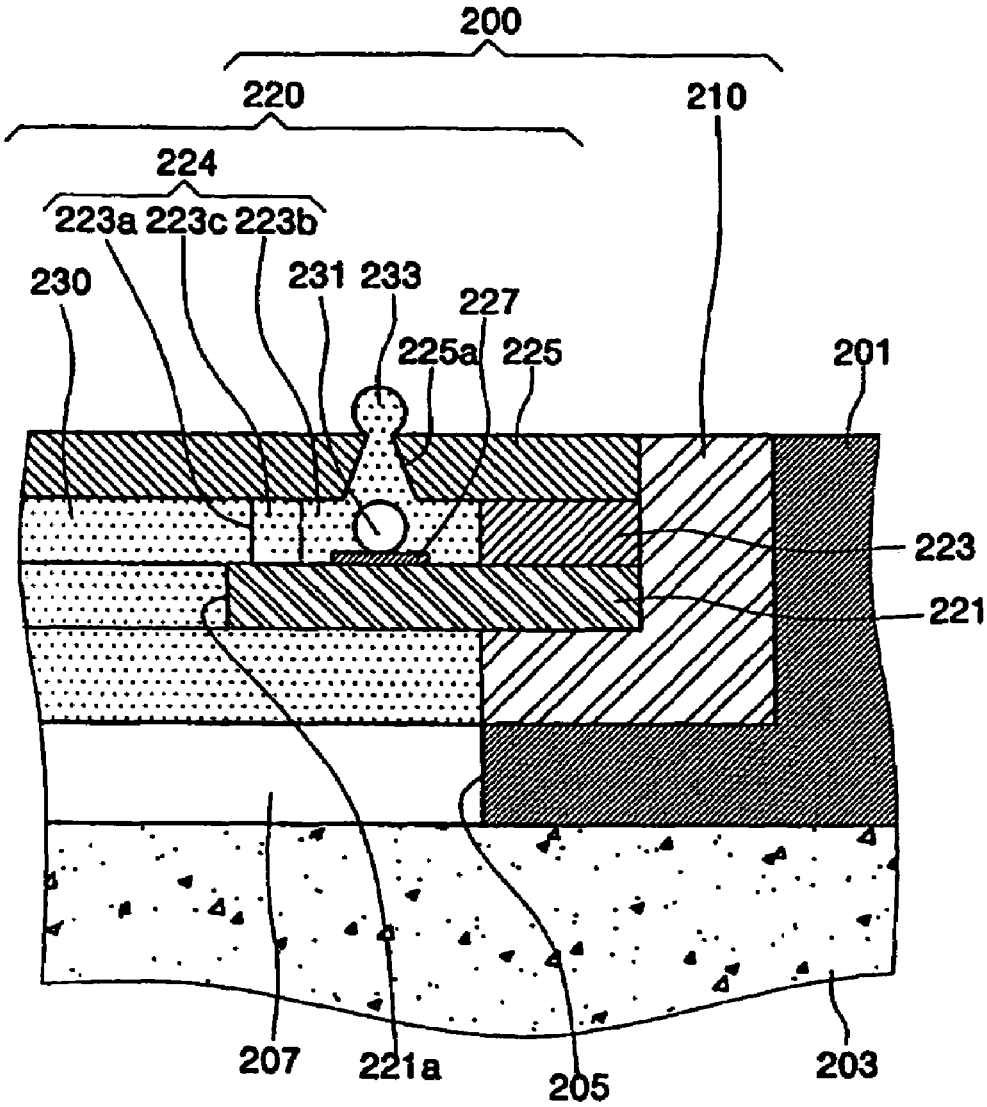
FIG. 12 is a partial cross-sectional view taken along the line II-II' shown in FIG. 5, illustrating an initial filling process of the ink into the fluid channel of the head through gel ejection.

FIG. 12 is a partial cross-sectional view taken along the line II-II' shown in FIG. 5, illustrating a process of initially filling the ink into the fluid channel 224 of the head 200 through gel ejection.

Referring to FIG. 12, an inkjet cartridge 201 includes a foam 203 to store the ink, an ink supply unit 205 to supply the ink from the foam 203 to the head 200, and a filter 207 to filter the ink when the ink is ejected from the ink supply unit 205.

When the pulse current is applied to the heat-generating body 227 through current applying means after the line head module 200 is mounted on the inkjet cartridge 201 configured as above, the heat-generating body 227 generates heat. The gel 230 filled in the chamber 223*b* is heated to become a sol, and is continuously heated to generate bubbles 231. The generated bubbles 231 are continuously expanded to thereby apply pressure to the liquid-phased gel 230 filled in the chamber 223*b* to eject the gel outside through the nozzle hole 225*a*. Then, when the bubbles are shrunk, the liquid-phased gel 230 is drawn back and refilled into the chamber 223*b*. At this time, shrinkage of the bubbles is caused by cooling of the heat-generating body 227 due to switching-off of the pulse current.

When the operation is continuously performed to eject the liquid-phased gel 230, the ink stored in the foam 203 is gradually introduced into the chamber 223*b* through the ink supply unit 205 via the ink via-hole 223*a* and the restrictor 223*c* to fully fill the fluid channel 224.

In this configuration, in order to facilitate the liquefaction of the gel 230, before applying the current to the heat-generating body 227 to eject the gel 230, the auxiliary heat-generating body 250 is heated, or low current is applied to the heat-generating body 227. Thereby, the gel is changed into the sol, and then the ejecting operation may be performed.

As disclosed above, the present general inventive concept has an advantage in that it is capable of initially filling the ink into the fluid channel in the head when the head is replaced, without using an individual suction apparatus.

In addition, the present general inventive concept has an advantage in that it is capable of decreasing loss of the ink by making the suction operation unnecessary.

Further, the present general inventive concept has an advantage in that it is capable of improving printing quality by decreasing a possibility of air existing in the fluid channel in the head.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet head comprising:

a substrate having a liquid supply hole;

a nozzle plate disposed on an upper surface of the substrate and provided with a nozzle hole to eject the liquid;

a fluid channel forming layer disposed between the substrate and the nozzle plate and providing a chamber and a fluid channel to connect the chamber and the liquid supply hole;

a heat-generating body disposed at a position of the chamber to generate energy to eject the liquid; and a filler filled in the fluid channel before installation of the inkjet head to an image forming apparatus to prevent air from being introduced into the fluid channel, wherein the filled filler is in a solid state and allowed to cause a phase transition into a liquid state during filling and discharging of the filler.

2. The inkjet head according to claim 1, wherein the filler is a gel and the filler is filled into the fluid channel as a liquid, allowed to gelatinize into a solid within the fluid channel, and transitioned into a liquid phase to discharge the filler from the fluid channel.

3. The inkjet head according to claim 2, wherein the gel is one selected from a group consisting of phthalic acid, glycerol, unsaturated polyester, collagen and agar.

4. The inkjet head according to claim 2, wherein the gel has a sol-gel transition temperature of about 0 to 100° C.

5. The inkjet head according to claim 2, wherein the gel has a sol-gel transition temperature of about 5 to 60° C.

6. The inkjet head according to claim 2, wherein the gel has a viscosity of sol of about 10 to 70 centipoises.

7. The inkjet head according to claim 2, wherein the heat-generating body preheats the gel to be transitioned into a liquid phase before ejecting the liquid.

8. The inkjet head according to claim 7, wherein a pulse current of a predetermined value is applied to the heat-generating body to eject the liquid, and a current of a lower value than the predetermined value is applied to the heat-generating body to preheat the gel.

9. The inkjet head according to claim 2, wherein the gel has a high viscosity at a low temperature and a low viscosity at a high temperature.

10. The inkjet head according to claim 1, wherein the substrate further comprises an auxiliary heat-generating body to heat the substrate to a predetermined temperature.

11. The inkjet head according to claim 1, wherein the heat-generating body is formed on the substrate.

12. The inkjet head according to claim 1, wherein the liquid is an ink.

13. A method of fabricating an inkjet head, comprising:

providing a substrate having a heat-generating body to generate energy for liquid ejection thereon, a fluid channel forming layer provided with a fluid channel including a chamber to provide a heat-generating space to eject the liquid, and a nozzle plate provided with a nozzle hole to eject the liquid; and filling a liquid filler to prevent air from being introduced into the fluid channel before installation of the inkjet head to an image forming apparatus, allowing the liguid filler to solidify within the fluid channel, wherein the filler transitions into a liquid phase when the filler is heated.

14. The method according to claim 13, wherein the filler is a gel which is injected into the fluid channel in a liquefied state at a high temperature, is gelatinized state at a low temperature within the fluid channel, and transitioned into a liguid phase to discharge the filler from the fluid channel.

15. The method according to claim 14, wherein the gel uses one selected from a group consisting of phthalic acid, glycerol, unsaturated polyester, collagen and agar.

16. The method according to claim 14, wherein the gel uses a material having a sol-gel transition temperature of about 0 to 100° C.

17. The method according to claim 14, wherein the gel uses a material having a sol-gel transition temperature of about 5 to 60° C.

18. The method according to claim 14, wherein the gel uses a material having a viscosity of sol of about 10 to 70 centipoises.

19. The method according to claim 13, wherein providing the substrate further comprises forming an auxiliary heat-generating body to heat the substrate to a predetermined temperature.

20. A method of exchanging an inkjet head, comprising:

providing the inkjet head fabricated by a method comprising forming, on a substrate, a heat-generating body to generate energy for liquid ejection, a fluid channel forming layer to form a chamber to provide a space to heat the liquid and a fluid channel to provide a liquid supply path connected to the chamber, and a nozzle plate having a nozzle hole to eject the liquid; and filling a filler into the fluid-channel before installation of the inkjet head to an image forming apparatus, the filler preventing air from being introduced into the fluid channel and being allowed to cause phase transition into a liquid state;

disposing the inkjet head in a head frame;

inserting the head frame into a head mounting groove of an inkjet cartridge to be exchanged; and heating the filler at a predetermined temperature to eject the filler toward an exterior through the nozzle hole.

21. The method according to claim 20, further comprising preheating the filler at a predetermined temperature to be liquefied before the filler is ejected.

22. The method according claim 21, wherein preheating the filler is performed by an auxiliary heat-generating body additionally formed on the substrate.

23. The method according claim 21, wherein preheating the filler is performed by applying a pulse current lower than that required to eject the liquid to the heat-generating body.

24. A process of filling ink into a fluid channel from an ink chamber of an inkjet head prior to installation of the inkjet head into an image forming apparatus, the inkjet head including the ink chamber having the fluid channel, a foam in the chamber to store ink, and an ink supply unit to supply ink from the foam to the inkjet head, the process comprising:

adding a liquid to the chamber, and allowing the liquid to gel within the chamber; and heating the gel in the chamber until the gel becomes a sol and generates bubbles and ejects through a nozzle hole in the inkjet head to the fluid channel, thus drawing the ink stored in the foam into the chamber through the ink supply unit and supplying the chamber with ink.

25. The process according to claim 24, wherein the heating of the gel comprises:

preheating the gel to facilitate liquefaction of the gel; and heating the gel until is becomes a sol.

26. The process according to claim 24, further comprising:

cooling the gel such that the gel is drawn back into chamber when the gel is not fully ejected from the inkjet head.

27. An inkjet head, comprising:

a substrate defining an ink supply hole and a plurality of ink chambers;

a nozzle plate disposed on an upper surface of the substrate and provided with a plurality of nozzle holes corresponding to the ink chambers to eject the ink;

a heater disposed in the chamber to eject the ink through the nozzles; and a filler pre-filled in the ink chambers before installation of the inkjet head into an image forming apparatus to prevent air from being introduced into the ink chambers, wherein the ink chambers are initially filled with the filler in liguid form, the filler is allowed to solidify within the ink chambers, and the heater heats the filler to change the filler back into a liquid state, to eject the filler through the nozzles, and to draw ink into the chambers through the ink supply hole.

28. The inkjet head of claim 27, wherein the filler is a gel.

29. A method of fabricating an inkjet head, comprising:

forming a substrate to define a plurality of ink chambers, forming a fluid channel layer to define a fluid channel to supply the ink chamber with ink;

forming a nozzle plate defining a plurality of nozzles to correspond to the ink chambers to eject the ink;

forming a heater at the ink chambers to heat the ink and eject the ink through the nozzles; and pre-filling the chambers with a liguid filler that gels within the chambers to prevent air from being introduced into the fluid channel and the chambers before installation of the inkjet head into a image forming apparatus, wherein the filler is transitioned into a liquid phase when the filler is heated by the heaters, and ejected through the nozzles to draw ink into the chambers.

* * * * *